United States Patent [19]

See

[11] 4,387,130

[45] Jun. 7, 1983

[54] TILES FOR FORMING SPORTS GROUND COVERINGS AND IN PARTICULAR SKI RUNS

[76] Inventor: Jacques L. A. See, 16A rue Jean Mermoz, 14800 Deauville, Calvados, France

[21] Appl. No.: 371,313

[22] Filed: Apr. 23, 1982

[30] Foreign Application Priority Data

Apr. 23, 1981 [FR] France ..... 81 08087

[51] Int. Cl.[3] ..... A01N 3/00

[52] U.S. Cl. ..... 428/17; 428/45; 428/47; 428/48; 428/52; 428/58; 428/84; 428/85; 428/88; 428/95

[58] Field of Search ..... 428/17, 45, 47, 48, 428/52, 58, 84, 88

[56] References Cited

U.S. PATENT DOCUMENTS 3,616,104 10/1971 Kuzmick ..... 161/21

4,161,558 7/1979 See ..... 428/17

*Primary Examiner*—Marion McCamish

*Assistant Examiner*—P. Schwartz

*Attorney, Agent, or Firm*—Browdy & Neimark

[57] ABSTRACT

The tiles define a succession of vaults on which protrude fingers or piles. One side of each plate has eyelets at the top of the vaults while the other side forms lugs able to be slidably engaged under the vaults of the contiguous tile. The plates are besides provided, on one of their end edges, with protruding rings corresponding to mating tongues formed beneath the opposite edge of a contiguous tile.

11 Claims, 6 Drawing Figures

TILES FOR FORMING SPORTS GROUND COVERINGS AND IN PARTICULAR SKI RUNS

TECHNICAL FIELD

The present invention relates to sports ground coverings, and more particularly to those to be used for forming ski runs.

More particularly, the invention relates to the tiles used for making sports ground coverings, which tiles define vaults and are jointed to other identical or similar tiles extending, on the one hand, in the longitudinal direction, and on the other hand, in the transverse direction.

BRIEF SUMMARY OF THE INVENTION

One of the major difficulties encountered when using sports ground coverings comprising tiles of the type of those hereabove used lies in the connection which has to be carried out on the one hand between the tiles extending in the longitudinal direction and on the other hand between the tiles extending in the transverse direction. It has appeared that the hitherto used fasteners can come apart so that the tiles can leave a free space between each other or overlap each other. In any case, they create a risk for the skiers when they are disassembled since a ski can engage between two tiles.

The starting point of the present invention is that it has been established that the joining portions between two contiguous tiles defining several vaults should be as resistant as the junction between two successive vaults of the same tile, but also exhibit the same flexibility regarding the joining of contiguous tiles the vaults of which are in alignment so that there be no break of continuity in the resistance of the ground covering realized, as well as in its flexibility.

The invention solves this problem.

According to the invention, the tiles used for forming sports ground coverings and particularly ski runs, said tiles being made of a succession of vaults from which protrude fingers or piles and below which protrude support fingers directly engaged into the ground or into an intermediate ground sheet, the vaults defining moreover openings, are characterized in that one lateral side of each tile is formed with eyelets at the top of some at least of the vaults while the other side defines lugs which can be slidably engaged under the vaults of a contiguous tile extending transversely relative to the first, one of the end edges of each tile being provided with protruding rings and the other end edge with tongues or barbs engaging into the protruding rings in order to provide the connection of the successive tiles in the longitudinal direction.

Various other features of the invention will become more apparent from the following detailed description.

BRIEF DESCRIPTION OF DRAWINGS

An embodiment of the invention is shown as a non limiting example in the appended drawings.

DESCRIPTION OF DRAWINGS

Figure 1:
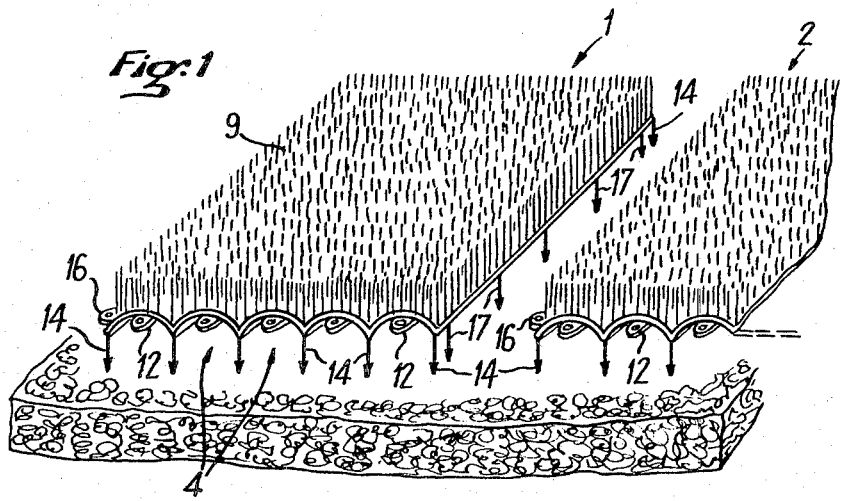
FIG. 1 is a schematic perspective view of the self-locking tiles for making sports ground coverings, notably ski runs.

In FIG. 1 are shown schematically two tiles 1 and 2 which are to be assembled in the longitudinal direction of the ground covering to be formed. Other identical tiles are provided for being assembled in the perpendicular direction, after or prior to the assembly in the longitudinal direction. The tiles bear preferably on a ground sheet which is however not necessary. When using a ground sheet, it is made of an imputrescible material, for example synthetic intermingled yarns, for forming a kind of felt or mattress similar to intermingled hair. The tiles 1 define in a manner known per se arches or vaults 4 in which are formed openings 5 having the shape of discontinuous herring-bones, each herring-bone having for example an extension corresponding substantially to that of two successive arches.

Figure 2:
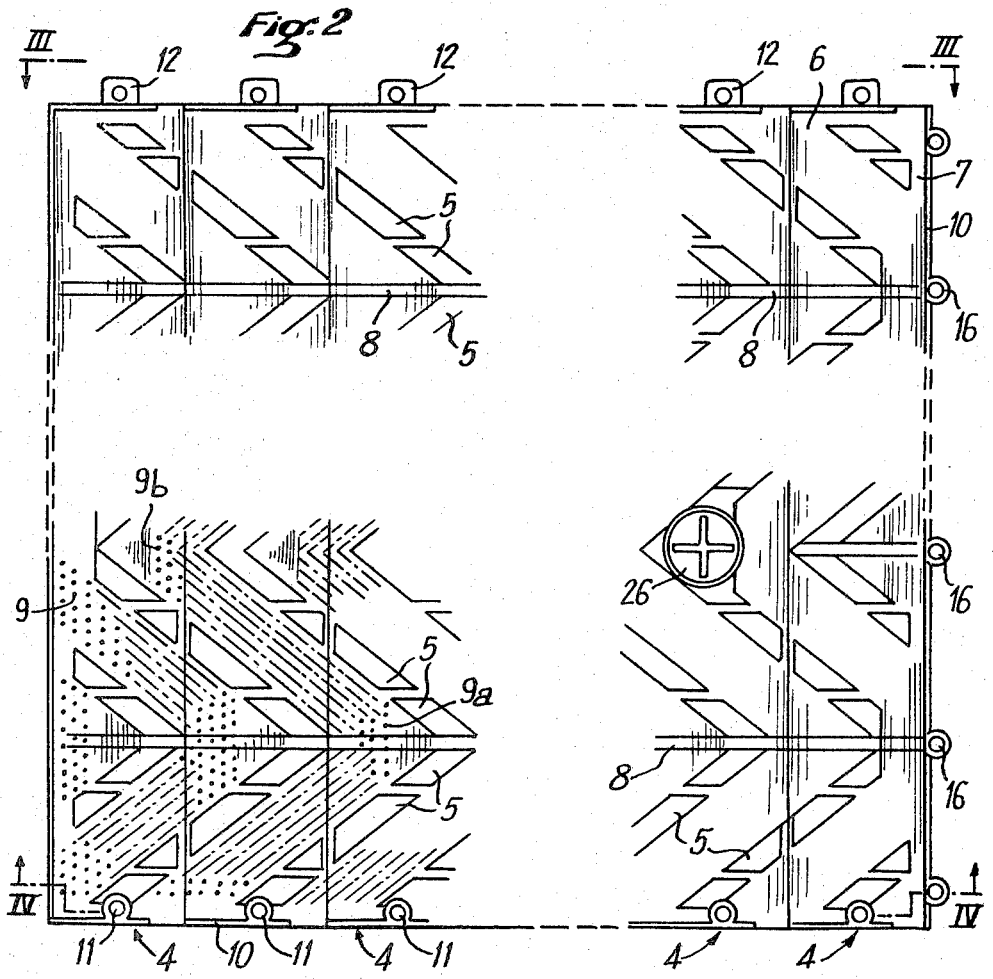
FIG. 2 is a plan view, seen from the top, of one of the pannels.
Figure 3:
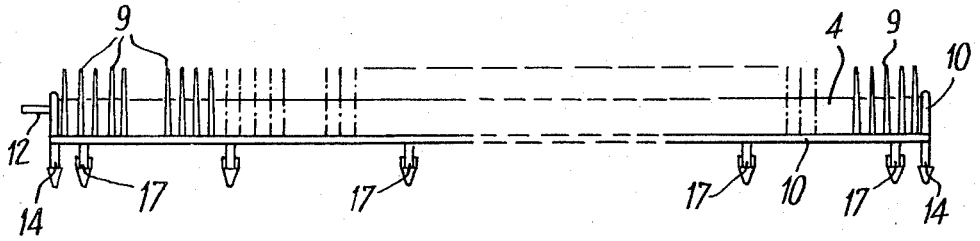
FIG. 3 is a partly schematic elevation view along line III—III of FIG. 2.

The discontinuous herring-bone shaped openings leave, on their lateral sides 6 as well as on their end sides 7, full spaces forming a peripheral belt for each tile, which is well visible in FIG. 2. Moreover, at least some of the portions of the tiles which are between openings 5 form protruding cords 8 constituting reinforcements. The number of cords 8 can vary, meaning that the cord can be formed each time between two contiguous openings 5 or only in alignment with continuous segments isolating two contiguous openings 5. Fingers or piles 9 are formed on the plane portion of the successive vaults in the manner shown in FIG. 2, viz. in areas also in the form of herring-bones interlocking into each other. However, it has been found out that it was advantageous that each pile herring-bone does not end into a point but according to a row of piles **9*a*, respectively 9*b*, having several front fingers or piles. The rows 9*a*, 9*b* stop preferably at a distance from the top of a vault, thereby avoiding that some of the fingers or piles are very short, or, on the contrary, that some are very long, the effect of which would be to create too variable flexibilities between the fingers or piles. Indeed, the top of all the fingers or piles extends in the same plane. In addition to the foregoing, it is advantageous that the lateral sides 6 and end sides 7 are bordered by a peripheral rib 10 (FIG. 3) increasing the rigidity of said sides. However, the rib of the lateral sides, viz. that which borders the vaults, is advantageously stopped at a short distance after the top of each vault in order not to reduce excessively the flexibility of said vaults. As is still illustrated in FIG. 2, each tile is formed at the top of each vault with an eyelet 11 bordering the portion of the corresponding peripheral ribs which is protruding above said vaults. The eyelets 11 are formed on only one lateral side of each tile, the other side forming a lug 12** protruding from underneath each vault.

Figure 4:
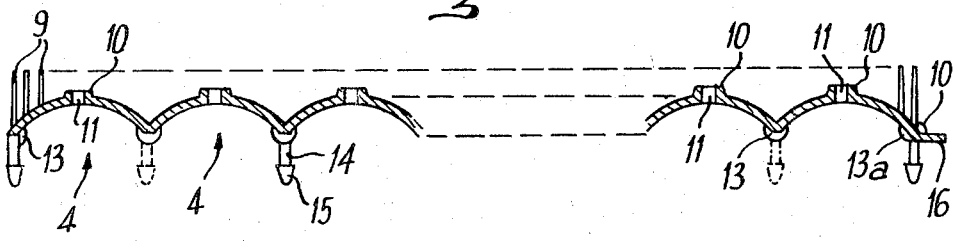
FIG. 4 is a sectional view along line IV—IV of FIG. 2.

The junction of each vault comprises a reinforcement rib 13 protruding below the tile, as is shown in FIG. 4, and from said rib, support fingers 14. The support fingers 14 are for example cylindrical and they form at their end a conical head 15 defining an anchoring barb enhancing the behaviour of the tile in the ground or the ground sheet. The reinforcement rib 13 which is on one of the lateral sides of each tile, that designated at **13*a* in FIG. 4, forms protruding rings 16 thus extending in the lowest plane of each vault. It is advantageous that the protruding rings 16 are placed in alignment with some of the protruding cords 8** so that they be placed in areas of the vaults having a particularly high resistance.

The second terminal side of each tile forms on its underneath side tongues 17 with two steps 18 and 19 off-set angularly and in height. The step 18 extends over about 180°, as is step 19, but said two steps are diametrically opposite. The steps 18 and 19 are formed on a cylindrical body 20 the diameter of which is only very slightly inferior to that of the opening of the protruding rings 16.

Figure 5:
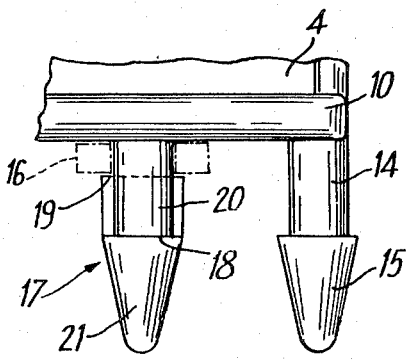
FIG. 5 is a greatly enlarged partial elevation view of a detail appearing on the right hand side of FIG. 3.
Figure 6:
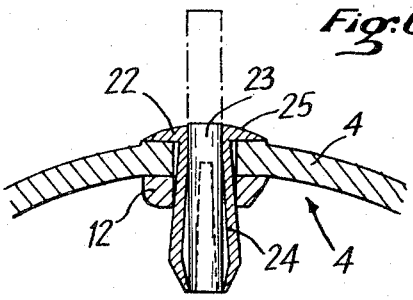
FIG. 6 is an explanatory sectional view of another detail, greatly enlarged.

As is illustrated in FIG. 5, the tongues 17 end in the same way as the support fingers 14 into a conical portion 21 the large base of which forms the step 18. For joining tiles in the longitudinal direction, the tile 2 for example (FIG. 1) is laid first on the ground or on the ground sheet, then the tongues 17 of tile 1 are engaged into the protruding rings 16 of said tile 2. This operation is carried out easily by presenting tile 1 so that it is slightly inclined relative to tile 2 already in position so that the step 18 is easily passed and step 19 is then passed by flexing the material constituent of each tongue 17. At the end of the engagement, each tongue 17 is in the position shown in FIG. 5 relative to each ring 16. In view of the stiffeners formed by the reinforcement ribs 13 and the peripheral rib 10, the connection existing between two consecutive tiles is extremely rigid, particularly if the tongues 17 are relatively close to each other, for example by a distance of the order of 6 to 7 cm. When several tiles have been assembled in the same way in the longitudinal direction, further tiles are assembled in the transverse direction. For so doing, it is enough to bring each time a tile in register with another tile and to align them so that the eyelets 11 are placed above the lugs 12 protruding from below the top of the vaults 4. As is shown in FIG. 6, a slit rivet 22 is then introduced in each eyelet and each lug, then a core 23 pertaining to each rivet is slided into the slit rivet so that the body 24 of the slit rivet is spread apart and locked in the lugs 12 while the rivet head 25 comes to rest on the top of each vault 4. It is advantageous to provide slit rivets 22 of a colour different to that of the tiles, which allows, should the occasion arise, checking if some rivets have been damaged or have escaped while the run is being used.

As appears from the foregoing, the assembly in the longitudinal direction of the tile is carried out at the lowest level of each vault which they define, while the transverse assembly is provided at the highest level of the vaults. In this manner, the effort applied to the tiles and which would have a tendency to spread them apart are distributed into two different planes so that the connection elements and the vaults work, in a way, as opposite walls of a case and provide a great homogeneity in the deformations to which the vaults are subjected, the top portion of which having always a tendency to be more deformed than the lower portion since the efforts of the skis is applied more directly on the top portion. In addition to the foregoing, and as is shown in FIG. 2, some at least of the areas in which are not formed fingers or piles 9 are used for defining a cross-piece 26 easily deformable and used for placing markers, for example slalom stakes. The cross-pieces 26 are formed at the top of the vaults so that they do not reduce the resistance of the tile and, moreover, the slalom stakes or other markers can be simply introduced in the cross-pieces 26 and rest on the ground without being engaged into it so as to be loosely maintained and therefore not to risk wounding a skier when manoeuvering.

The invention is not limited to the embodiment shown and described in detail and several modifications can be carried out without departing from its scope.

In particular, the tiles can be moulded from different materials, the choice of which depends on their use, the technician using necessarily materials of different nature according to whether said tiles have to be used or not indoors or outdoors or again when they are subjected to the action of ultraviolet rays in mountains.

I claim:

1. In tiles for forming sports ground covering and in particular ski runs, said tiles being made of a succession of adjacent apertured vaults with fingers or piles protruding above the vaults and support fingers protruding below said vaults, said support fingers being directly engageable into the ground or into an intermediate ground sheet, each of said tiles comprising two opposite lateral sides and two opposite end edges, the improvement wherein one of the lateral sides of each of said tiles is covered with eyelets on top of at least some of the vaults while the opposite lateral side of each of said tiles comprises lugs slidably engageable under the vaults of an adjacent tile extending transversely relative to a first tile for a transverse connection of contiguous tiles, and wherein one of the end edges of each of said tiles is provided with protruding rings and the opposite end edge of each of said tiles is provided with tongues engageable into said protruding rings for longitudinal connection of successive tiles.

2. A tile according to claim 1, wherein said eyelets and lugs for transverse connection of contiguous tiles are at a highest level of the vaults and wherein said rings and tongues for a longitudinal connection of the tiles are at a lowest level of the vaults.

3. Tiles according to claim 1, wherein connection between said vault eyelets and said lugs of two contiguous tiles is provided by slit rivets or similar members.

4. Tiles according to claim 1, wherein said tongues include two steps, said two steps being off-set in height, extending respectively over about 180°, and being disposed diametrically opposite.

5. Tiles according to claim 1, wherein said eyelets have an edge, the edge of said eyelets being reinforced by a rib extending also over a portion of each vault.

6. Tiles according to claim 1, wherein the joining portions of the vaults comprise reinforcement ribs which are underneath each tile.

7. Tiles according to claim 1, wherein the end edges of each tile include a reinforcement rib extending underneath the tile and a peripheral rib extending over said protruding rings.

8. Tiles according to claim 1, wherein said tongues have a cylindrical body, the cross section of said cylindrical body having a radius slightly inferior to the diameter of the opening of said protruding rings.

9. Tiles according to claim 1, wherein said protruding rings are formed in prolongation of protruding cords defining the vaults on the top and at least some of which separate the apertures of the apertured vaults.

10. Tiles according to claim 1, wherein the apertures of the apertured vaults are formed in a discontinuous herring-bone pattern, said apertures being stopped at a distance from the lateral sides and end edges of the tiles.

11. Tiles according to claim 1, comprising opened cross-pieces formed at intervals from the top portion of the vaults for introduction of markers.

* * * * *